United States Patent [19]

Chick

[11] Patent Number: 4,966,350

[45] Date of Patent: Oct. 30, 1990

[54] WIDE-OPENING VISE

[75] Inventor: James P. Chick, Jefferson Township, Butler County, Pa.

[73] Assignee: James P. Chick, Butler, Pa.

[21] Appl. No.: 279,853

[22] Filed: Dec. 5, 1988

[51] Int. Cl.[5] ..... B25B 1/10

[52] U.S. Cl. ..... 269/43; 269/88; 269/247; 269/154

[58] Field of Search ..... 269/43, 136, 138, 154, 269/290, 249, 906, 152, 153, 242, 88, 279, 282, 9

[56] References Cited

U.S. PATENT DOCUMENTS 3,061,302 10/1962 Dennis ..... 269/88

4,529,183 7/1985 Krason et al. ..... 269/43

4,583,724 4/1986 Huang ..... 269/88

*Primary Examiner*—Robert C. Watson

[57] ABSTRACT

By providing apparatus such as that shown in U.S. Pat. No. 4,529,183, but with the removable central jaw bolted from the top and means provided at the handle end of the device to fix the location of the one of the movable jaws of the structure as shown in the above-mentioned patent, there is obtained a particularly useful apparatus which will do everything that can be done with the vise of the above-mentioned patent, plus being able to conduct precision machining upon individual pieces which are considerably larger in the grasped dimension.

4 Claims, 3 Drawing Sheets

WIDE-OPENING VISE

BACKGROUND OF THE INVENTION

1. Field of the Invention

This invention relates to the precision machining of workpieces and to a form of vise for use therein.

2. Description of the Prior Art

Those skilled in the art are aware of the vise shown in U.S. Pat. No. 4,529,183, which is a precision vise having means for holding workpieces in each of two positions with respect to a central fixed jaw. The problems which can be solved when a central fixed jaw is in position are adequately explained in the above-mentioned patent.

In the structure shown in U.S. Pat. No. 4,529,183, the central fixed jaw member is shown as being bolted from the bottom, rather than from the top, and the equipment also lacks a detachable means attached to the handle end of the device which is capable of securing the movable jaw proximal to the handle in a predetermined position.

It has been evident to those skilled in the art that the structure shown in U.S. Pat. No. 4,529.183, while it is very advantageously useful for the handling of the precision machining of workpieces that need to be worked upon while they are in two different orientations, nevertheless is not especially suitable for jobs which occasionally arise and involve the grasping of a workpiece through a relatively large grasped dimension. In the commercially available version of the vise shown in the above-mentioned patent, the greatest grasped dimension is on the order 3 or 4 inches, and it is frequently desirable to be able to work with workpieces where the grasped dimension is considerably greater, being on the order of 10 or 12 inches. At the same time, it is desirable for the equipment to be such that it may readily be converted to a two-place vise and operated in the particular manner described in the above-mentioned patent.

The applicant has had a considerable measure of commercial success with the marketing of a device which, accordingly, represents a modification of the equipment shown in the above-mentioned patent, such that the central jaw member is bolted from above, so that it is readily accessible for removal, and detachable means are provided near the handle end of the screwshaft for fixing the location of one of the two jaws of the apparatus traversed by the screwshaft operated by the above-mentioned handle.

SUMMARY OF THE INVENTION

By providing apparatus such as that shown in U.S. Pat. No. 4,529,183, but with a removable central jaw bolted from the top and means provided at the handle end of the device to fix the location of the one of the movable jaws of the structure as shown in the above-mentioned patent, there is obtained a particularly useful apparatus which will do everything that can be done with the vise of the above-mentioned patent, plus being able to conduct precision machining upon individual places which are considerably larger in the grasped dimension.

DESCRIPTION OF THE DRAWING

A complete understanding of the invention may be obtained from the foregoing and following description thereof, taken in conjunction with the appended drawings, in which.

DESCRIPTION OF THE PREFERRED EMBODIMENTS

In one form of the apparatus according to the invention, a form which has been made and sold by the applicant, there is provided a precision vise which conforms substantially in all respects, except those more particularly hereinbelow discussed, with the precision vise shown and disclosed in U.S. Pat. No. 4,529,183, issued July 16, 1985, the disclosure of which is hereby incorporated by reference. In other words, it is intended that there be provided in accordance with the invention a vise which is entirely capable of being operated, the same as the vise of U.S. Pat. No. 4,529,183 as a two-place vise for the precision machining of two separate workpieces in one cycle of operation of numerical-control equipment. At the same time, however, it is intended that the apparatus shown and described in the above patent be modified by the inclusion of certain additional parts and features, in order to extend the range of its usefulness, especially in the direction of being able to hold single workpieces of a greater grasped dimension than can be accommodated with the apparatus shown and described in the above-mentioned U.S. patent.

Figure 1:
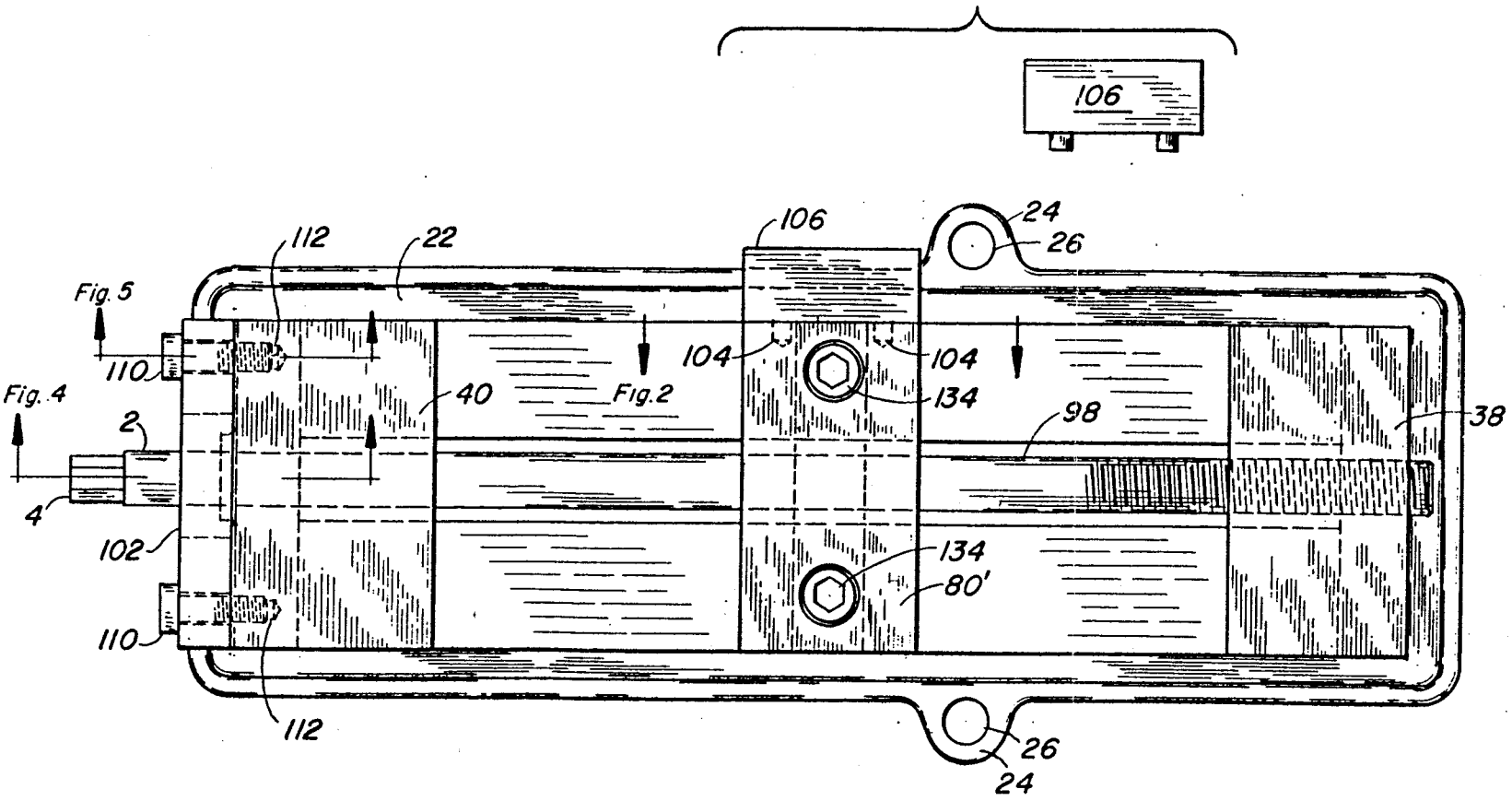
FIG. 1 is an overall plan view of apparatus comprising one embodiment of the invention.

Accordingly, there is provided in accordance with the present invention a precision vise having features as indicated in FIG. 1. In FIG. 1 there can be seen in plan view the outline of a base member 22 having a pair of ears 24 which contain openings 26 in order to permit the precision vise to be secured to the working table of suitable numerical-control machining equipment in a manner well understood by those of ordinary skill in the art.

The apparatus shown in FIG. 1 including a screwshaft 2, which has at one end 4 thereof a portion which is square or hexagonal or otherwise polygonal, in order that it may be suitably attached to a handle 6, and it is also provided that the screwshaft 2 is threaded at its distal end, as is indicated at 98, for engagement with the movable jaw 38 or the slide associated therewith. The screwshaft 2 passes through a bore in the movable jaw 40 of the two-place vise or the slide associated therewith. Those skilled in the art will understand that when the handle 6 is appropriately rotated and there are workpieces which are to be grasped in two places, namely, between the movable jaw 38 and the removable central "fixed" jaw 80' and between the removable central "fixed" jaw 80' and the movable jaw 40, then it will ordinarily be possible, when the horseshoe member 102 of the invention is not used, for the movable jaw 38 to move in sufficiently with respect to the central jaw 80' to grasp a first workpiece, and then, upon further rotation of the handle 6, the screwshaft 2 through its increased-diameter portion 12 bears against the movable jaw 40 or the slide associated with it, such that there can then be closed, by further rotation of the screwshaft 2, the gap between the fixed jaw 80' and the movable jaw 40 of the two-place vise. The screwshaft 2 is mounted for "floating" movement axially, to make this action possible.

The equipment discussed above, and the matter of operating it, corresponds with the description of the invention afforded in U.S. Pat. No. 4,529,183. Although it is not precisely stated in that patent, in the embodiment of the invention made and commercially sold in accordance with that invention, the removable central fixed jaw 80 was secured in its position by means of bolts, ones that were never intended to be removed during the life of the equipment, with said bolts having their heads located beneath the equipment.

As shown FIG. 1, in accordance with present invention, there is provided a removable central fixed jaw 80', there is optionally but desirably also provided a block 106 having thereon a pair of pins 108 which are of such size as to be able to be snugly inserted in the indentations 104, such that when the bolts holding the removable central fixed jaw 80' have been removed, it is possible by striking the block 106 with a hammer or the like to dislodge the central fixed member 80' from its location in the equipment. Instead of pins, bolts may be used, if desired.

FIG. 1 further indicates that there are bolts 110 which project through bores in the horseshoe member 102 and are fastened into the movable jaw 40 of the two-place vise as indicated at 112.

Figure 3:
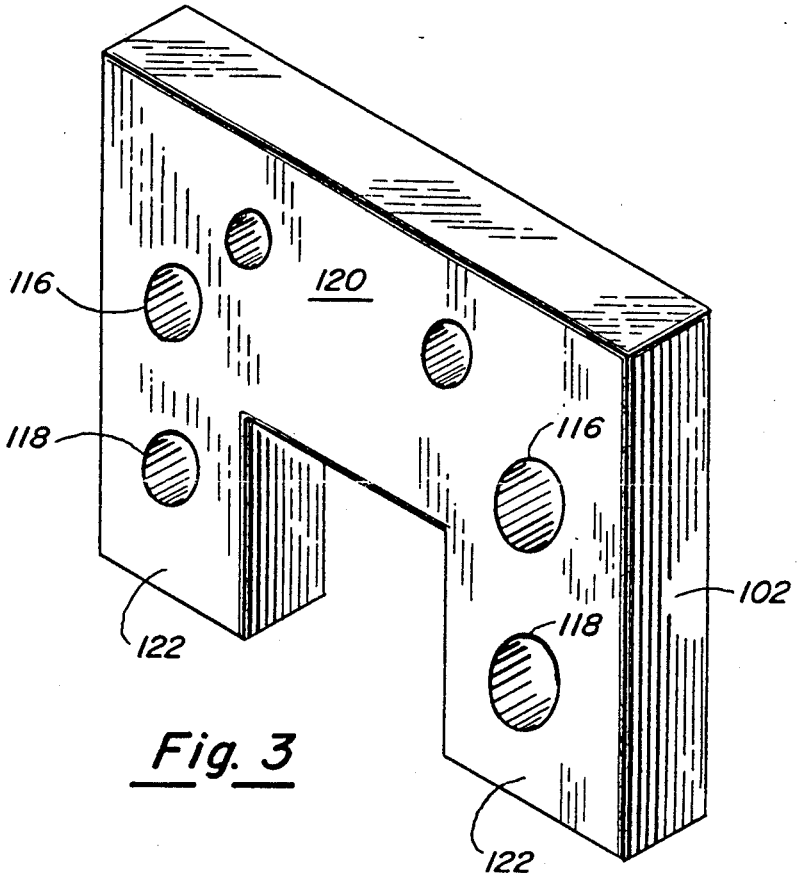
FIG. 3 is a pictorial view of a second part of the apparatus indicated in FIG. 1.
Figure 5:
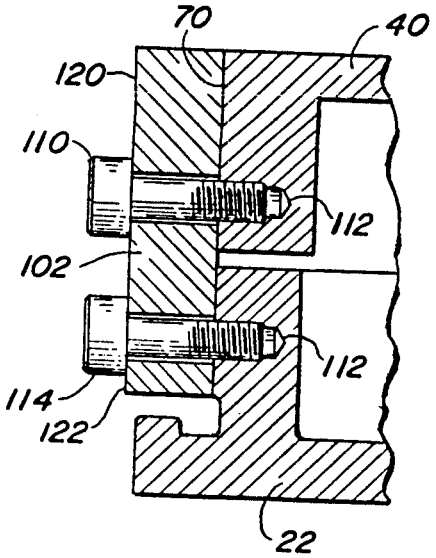
FIG. 5 is a further elevation view, in section, taken on the line V—V in FIG. 1.

Shown in FIG. 5 ar the heads 114 of other bolts which pass through the horseshoe member 102, below the bores which accommodate the bolts 110. In accordance with a preferred embodiment of the invention, the bolts 110 are passed through bores 116 of the horseshoe member 102 as shown in FIG. 3, and the bolts 114 are passed through the bores 118 in the horseshoe member 102 of FIG. 3.

Figure 4:
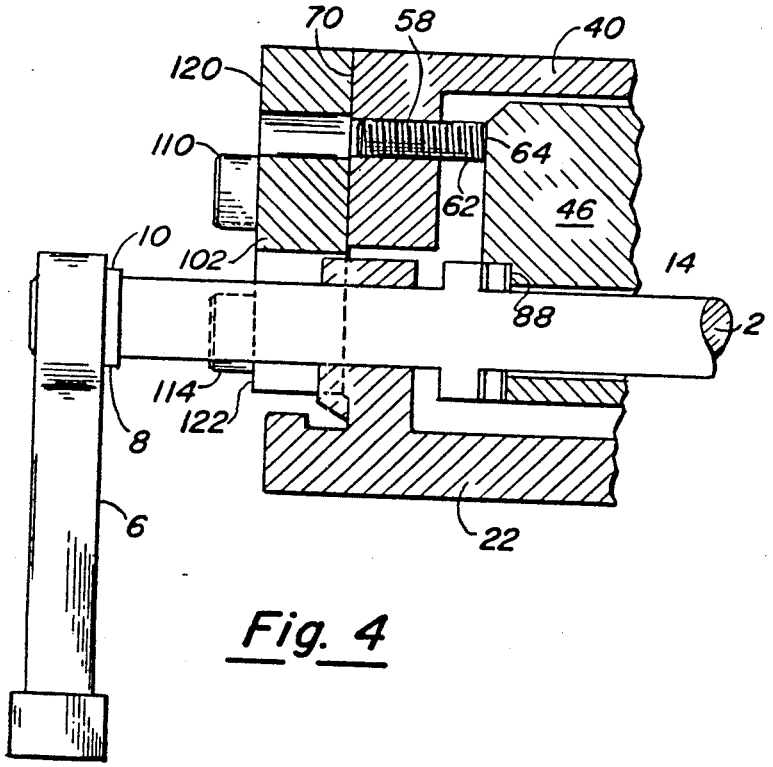
FIG. 4 is an elevation view, partly in section, taken on the line IV—IV of FIG. 1, illustrating one essential feature of the apparatus according to the present invention.

As can be seen from FIG. 4, the horseshoe member 102 is installed on the vise, when it is to be used in its wide-opening mode and with the removable central jaw 80' removed, in such a manner that the upper part 120 of the horseshoe member 102 is bolted to the movable jaw 40 and the lower part 122, containing the bores 118, is bolted to an appropriate machine face of the base of the vise, and it is important, for the purposes of the invention, that it, the horseshoe member 102 have a smooth ground and polished planar surface 128 which faces the end of the vise that is proximal to the handle 6. Moreover, the horseshoe member 102 is provided, similarly, with a ground and polished planar surface, at least in the portions thereof which are, in use, adjacent to the movable jaw 40 and the above-mentioned surface 128.

Figure 2:
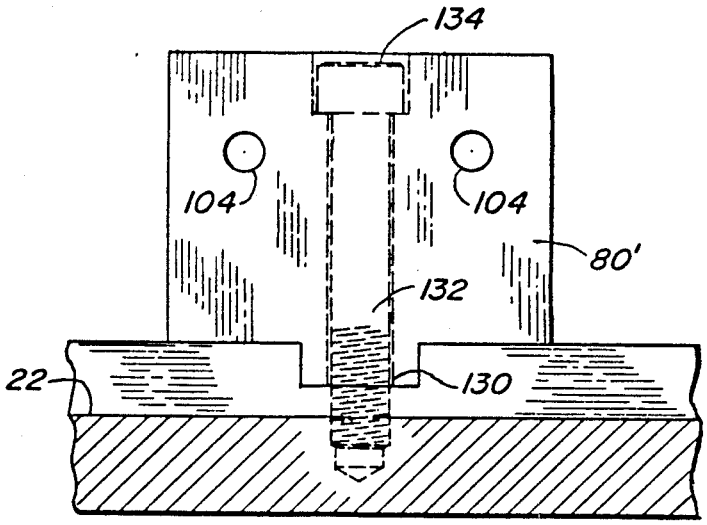
FIG. 2 is an elevation view of a second part of the apparatus indicated in FIG. 1.

FIG. 2 is an elevation view, indicating how the removable central fixed jaw member 80' is keyed into the base 22 as at 130 and secured therein by means of a bolt 132, the head of which is preferably contained within a suitable counterbore 134. Also shown in FIG. 2 are the indentations 104 mentioned above.

Those skilled in the art will readily understand how the equipment described above may be operated.

In one condition of the equipment, as, for example, when it is received by a customer from its manufacturer, the central jaw 80' is bolted into place, and the horseshoe member 102 is held to the end of the vise nearest to the handle by means of its adhesive tape. When the horseshoe member 102 is removed and set aside, the precision vise is then in condition to be used as a two-place precision vise.

When it is desired to operate the convertible precision vise of the invention as a single-place wide-opening precision vise, then the bolt or bolts 132 are removed, and if desired, the block 106 is used to loosen the central jaw 80' from its place. The horseshoe member 102 is bolted to the surface 128 and to the movable jaw 40.

It will be understood, from a reading of U.S. Pat. No. 4,529,183, that the basic vise is one in which the shaft 2 is not threadedly connected to the movable jaw 40 but only to the movable jaw 38, such that by rotation of the screwshaft 2 by means of handle 6, the movable jaw 38 may be then set to a desired position.

Although in the initially conceived embodiment of the invention, removable central jaw 80' is bolted into place from the top, it will be apparent to those skilled in the art that there are other means which may also appropriately be used. The important consideration is that the central jaw be secured to the base by some means which is accessible without removal of the vise from its precisely known position on its supporting table.

Moreover, in respect to affixing one of the movable jaws to the base, there may be used a precision stripper or shoulder bolt in place of the other means described above.

While I have shown and described herein a certain embodiment of my invention, I intend to cover as well any change of modification therein which may be made without departing from its spirit and scope.

I claim as my invention:

1. A precision machine vise which is convertible between:

a first function of operating as a two-place precision vise which is capable of grasping first and second workpieces against a central jaw member which has opposing planar faces adapted to serve as datum planes for the holding of the two workpieces, with grasping pressure being put onto each of said first and second workpieces by means of a screwshaft which is threadedly engaged with a first movable jaw and is mounted for free axial translational movement and comprises means for exerting pressure against a second movable jaw and a second function of operating as a one-place and wider-opening precision vise, said vise comprising a removable central fixed jaw member snugly keyed into the base of the vise and bolted thereto from the top, a portion of the base of said vise which is proximal to the operating handle of said vise, said portion having a smooth ground and polished substantially planar surface extending in a vertical direction, a horseshoe-shaped member adapted to be brought into contact with said surface extending in a vertical direction and into contact with a vertically extending smooth planar surface of said second movable jaw, said horseshoe-shaped member having bores therein which register with threaded openings in said vertically extending surface portion of said base and in said second jaw member, and bolt means for securing said second jaw member and said portion to said horseshoe-shaped member, whereby said second jaw member is held in a fixed position when said vise is operated in the mode of said second function.

2. A precision machine vise as defined in claim 1, characterized in that said removable central fixed jaw member has in a side thereof a pair of indentations, and the equipment further comprises a block having in a side thereof means which are adapted to fit into the indentations and aid in the removal of said removable central fixed jaw member.

3. A precision machine vise which is convertible between:

a first function of operating as a two-place precision vise which is capable of grasping first and second workpieces against a central jaw member which has opposing planar faces adapted to serve as datum planes for the holding of the two workpieces, with grasping pressure being put onto each of said first and second workpieces by means of a screwshaft which is threadedly engaged with a first movable jaw and is mounted for free axial translational movement and comprises means for exerting pressure against a second movable jaw and a second function of operating as a one-place and wider-opening precision vise, said vise comprising a removable central fixed jaw member snugly keyed into the base of the vise and secured thereto by means accessible without removal of the vise from its precisely known position on its table, and means are provided for affixing one of said movable jaws to said base.

4. A vise as defined in claim 3 wherein said means for affixing one of said movable jaws to said base comprise a precision stripper or shoulder bolt.

* * * * *